US007886828B1

(12) United States Patent
Shivers, III et al.

(10) Patent No.: US 7,886,828 B1
(45) Date of Patent: Feb. 15, 2011

(54) FLOATING VESSEL FOR SUPPORTING TOP TENSION DRILLING AND PRODUCTION RISERS

(75) Inventors: Robert Magee Shivers, III, Houston, TX (US); David Trent, Cypress, TX (US); Daniel H. Longwell, Houston, TX (US)

(73) Assignee: ATP Oil & Gas Corporation

( * ) Notice: Subject to any disclaimer, the term of this patent is extended or adjusted under 35 U.S.C. 154(b) by 233 days.

(21) Appl. No.: 12/203,010

(22) Filed: Sep. 2, 2008

(51) Int. Cl.
*E21B 29/12* (2006.01)
*E21B 7/12* (2006.01)

(52) U.S. Cl. ..... 166/355; 166/345; 166/359; 166/352; 405/224.4

(58) Field of Classification Search ..... 166/350–355, 166/345, 359; 405/224.2–224.4, 223.1
See application file for complete search history.

(56) References Cited

U.S. PATENT DOCUMENTS 4,379,657 A * 4/1983 Widiner et al. ..... 405/224.4
4,808,035 A * 2/1989 Stanton et al. ..... 405/224.4
5,310,007 A * 5/1994 Parikh ..... 166/355
5,873,678 A * 2/1999 Moses ..... 405/223.1
6,045,296 A * 4/2000 Otten et al. ..... 405/195.1
6,173,781 B1 * 1/2001 Milne et al. ..... 166/355
6,554,072 B1 * 4/2003 Mournian et al. ..... 166/355
6,688,814 B2 * 2/2004 Wetch et al. ..... 405/224.2
6,789,981 B2 * 9/2004 Pollack ..... 405/224.4
7,144,048 B2 * 12/2006 Humphreys ..... 285/290.3
7,231,981 B2 * 6/2007 Moe et al. ..... 166/355
7,329,070 B1 * 2/2008 Trent et al. ..... 405/224.4
7,438,505 B2 * 10/2008 Olsen et al. ..... 405/224.4
7,588,393 B1 * 9/2009 Shivers et al. ..... 405/224.4
7,654,327 B1 * 2/2010 Shivers et al. ..... 166/345
2005/0147473 A1 * 7/2005 Pallini et al. ..... 405/224.4
2006/0078390 A1 * 4/2006 Olsen et al. ..... 405/224
2007/0196182 A1 * 8/2007 Ellis ..... 405/224.4
2008/0031692 A1 * 2/2008 Wybro et al. ..... 405/224.4
2008/0304916 A1 * 12/2008 Crotwell et al. ..... 405/224.2

* cited by examiner

*Primary Examiner*—Thomas A Beach
(74) *Attorney, Agent, or Firm*—Buskop Law Group, PC; Wendy Buskop

(57) ABSTRACT

A floating vessel for supporting top tension drilling and production risers having a hull and an operation deck disposed on top of the hull. A tensioner assembly for moveably carrying a conductor that communicates from a wellhead to a piece of well access equipment. The well access equipment is connected to the floating vessel. The tensioner assembly is supported by the floating vessel.

8 Claims, 7 Drawing Sheets

FLOATING VESSEL FOR SUPPORTING TOP TENSION DRILLING AND PRODUCTION RISERS

FIELD

The present embodiments relate to a vessel for supporting top tension drilling and production risers.

BACKGROUND

A need exists for a floating vessel supporting a tensioner assembly that eliminates the need for riser centralizers or stabilization between a tension ring and well head equipment, when the tensioner stroke range is large. A need exists for tensioner system that achieves stabilization by compensating a conductor, which transfers tension from the cylinders to the riser.

A need further exists for a conductor that can protect the riser from impact with a vessel, and which can provide shelter from wave loading in a wave zone.

The present embodiments meet these needs.

BRIEF DESCRIPTION OF THE DRAWINGS

The detailed description will be better understood in conjunction with the accompanying drawings as follows.

Figure 1:
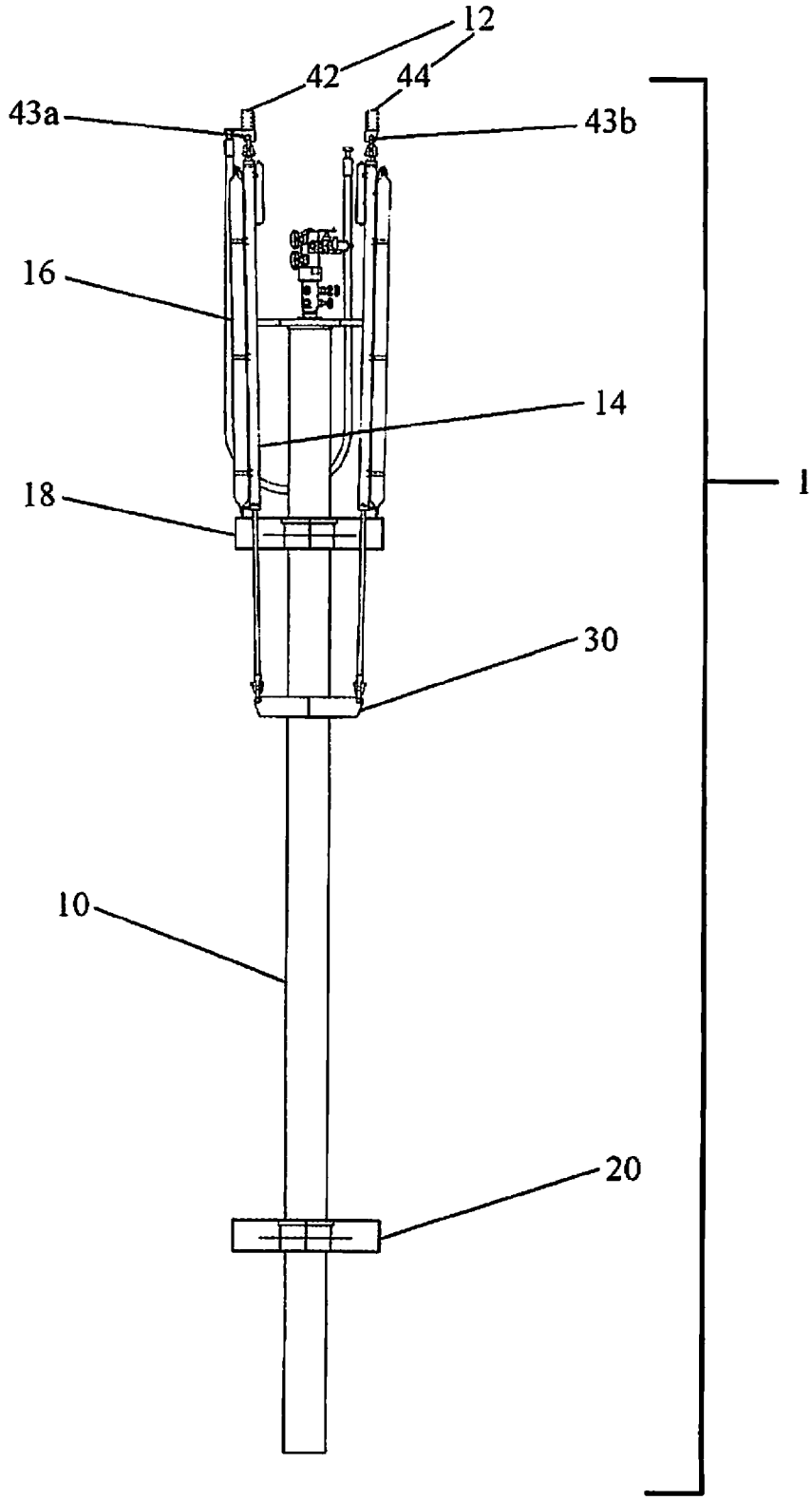
FIG. 1 depicts front view of the tensioner assembly.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments can provide stabilization of a riser and reduce the equipment needed to stabilize the riser. This reduces costs associated with riser systems, and enhances the safety of the riser system.

The embodiments generally relate to a floating vessel for supporting top tension drilling and production risers. The floating vessel for supporting top tension drilling and production risers has a hull and an operation deck. The operation deck can be disposed on the top of the hull.

The floating vessel can be a semi-submersible floating vessel, a ship, a deep draft cassion, barge, a tension leg platform, or a similar floating vessel.

The floating vessel for supporting top tension drilling and production risers has a tensioner assembly for moveably carrying a conductor that communicates from a wellhead to a piece of well access equipment. The tensioner assembly is supported by the floating vessel for supporting top tension drilling and production risers. It is contemplated that a plurality of tensioners can be supported by the floating vessel for supporting top tension drilling and production risers.

In an embodiment, the floating vessel can have a derrick or mast disposed on the operation deck, and the tensioner assembly can be secured to a derrick or mast.

The tensioner can have a support frame. The support frame can be secured to the floating vessel. At least one hydraulic cylinder can be connected to the support frame. In an embodiment there can be four cylinders. The hydraulic cylinders can have a pressure from about 100 psi to about 3500 psi, and can provide a load from about 200 kips to about 2500 kips.

The support frame can have a first beam parallel to a second beam. The first beam and the second beam can be secured to the operations deck. Both the first beam and second beam can have a pad eye for supporting the hydraulic cylinder.

The pad eyes can have a diameter for receiving a shackle to hold the hydraulic cylinders. The pad eyes can be disposed on the beams or they can be integral with the deck of a vessel.

The first beam and second beam can be a steel I-beam, a steel C-beam, tubulars, or similar structural beam.

In another embodiment the support frame can be a cassette frame. A cassette frame can be square, octagon, hexagon shaped and sized to fit within a well bay.

In an embodiment of the floating vessel for drilling operations the well access equipment can be disposed in the vessel.

The well access equipment can include blow out preventers, production trees, or similar well access equipment.

The tensioner can have at least one primary accumulator in fluid communication with the hydraulic cylinder. The accumulator can be either directly connected to the hydraulic cylinder or can be in a remote location and connected by a conduit, an umbilical, or a jumper to the hydraulic cylinder. The accumulator can have a capacity of at least 1 gallon. The accumulator capacity can exceed 470 gallons.

The tensioner can have an upper conductor guide and a lower conductor guide slidably engaged with the conductor. The upper and lower conductor guides can both have a guide frame for supporting a conductor guide wear pad.

The upper conductor guide and the lower conductor guide can have different dimensions. The upper conductor guide and the lower conductor guide can be made from metal, composite, or similar structural material. The lower conductor guide can be made from the same or different material as the upper conductor guide.

The conductor guide frame can be metal, composite, or similar structural material. The conductor guide frame support conductor guide wear pads using a conductor guide retaining ring. The conductor guide retaining ring can be metal, composite, or any structural material. The conductor guide ring can be attached to the conductor guide frame by bolting, welding, or similar mechanical means. The conductor guide ring can be a complete ring or a segment of a ring.

The conductor guide wear pad can be made from an ultra high molecular weight polymer. The ultra high molecular weight polymer can be polypropylene, polyethylene, polybutylene, homopolymer, and copolymers thereof. The conductor wear pads can also be metal or any bearing material.

A tension frame can be secured to the conductor between the upper and the lower conductor guides for transferring tension from the at least one hydraulic cylinder to the conductor and the riser. The tension frame can be made from steel and can have a square, round, or rectangular shape. The tension frame can transfer tension from the hydraulic cylinder to the conductor. The tension frame can be removably secured to the conductor. An example of how the tension frame can be repeatably connected to the conductor includes bolts, welds, or other similar mechanical means.

The hydraulic cylinder can be secured to the tension frame by the use of a shackle, or another pin connection.

The tapered bowl tension ring assembly can include a tension disc having a tapered center. Tapered collets can engage the tension disc and a collet support ring can be disposed on the tapered collets to hold the collets together. The collet support ring can be steel or another structural and stiff member. The tapered collets engage the riser and are held together by the collet support ring.

The collet support ring is secured to the tension disc. The tension disc can have an outer diameter segment that engages the conductor with a thickness that is about 50 percent to about 70 percent the thickness of the inner diameter segment of the tension disc. The tension disc engages the collets that engage the riser. The tension disc can be made from metal and can have a diameter ranging from about 28 inches to about 63 inches.

In another embodiment the tension ring assembly can include a single tension disc directly engaging the conductor, and supporting the riser.

In an alternative embodiment the tension disc can be a solid segment with perforations.

The embodiments of the invention can be best understood with reference to the Figures.

Figure 2:
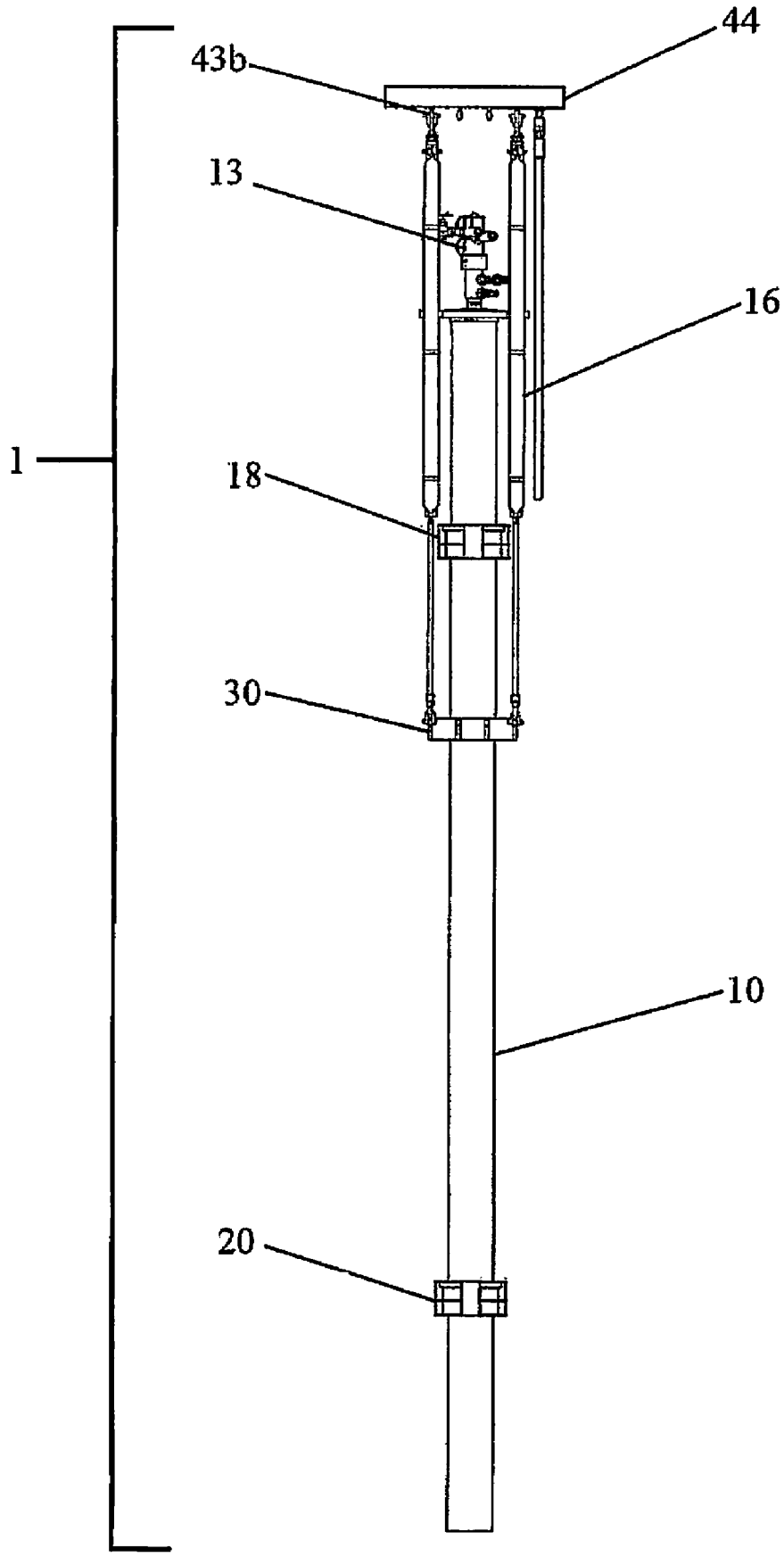
FIG. 2 depicts a side view of the tensioner assembly.
Figure 6:
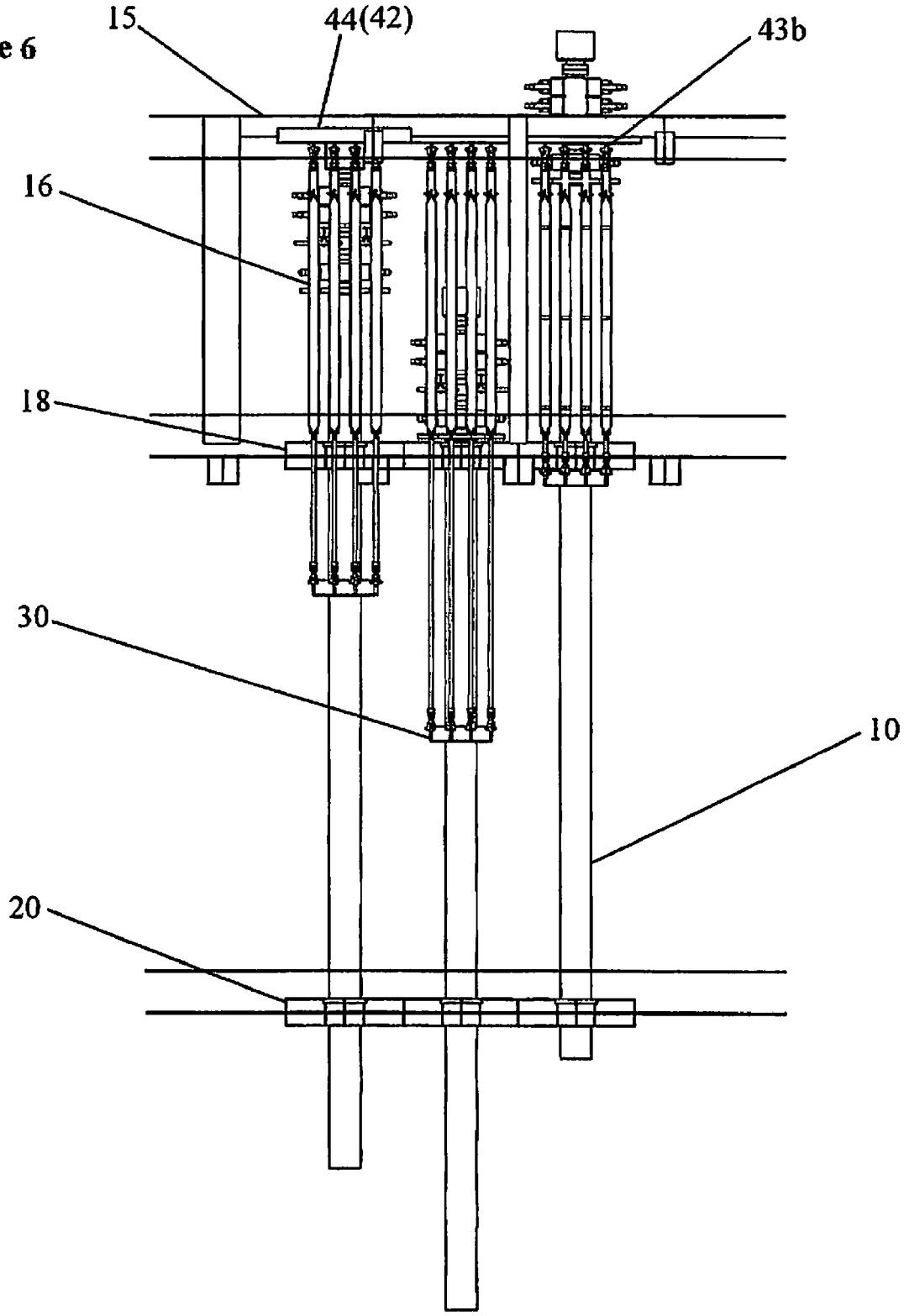
FIG. 6 depicts a side view of the tensioner assembly secured to a vessel.

Referring now to FIGS. 1, 2, and 6, the tensioner assembly 1 has a conductor 10. The conductor 10 can be a fifty four inch outside diameter steel pipe. A tension frame 30 is secured to the conductor 10 and at least one hydraulic cylinder 14. The hydraulic cylinder 14 is secured to a support frame 12. The support frame 12 is depicted having a first beam 42 parallel to a second beam 44. The first beam 42 and the second beam 44 can be connected to a rig 15. A first beam pad eye 43*a* is disposed on the first beam 42. A second beam pad eye 43*b* is disposed on the second beam 44.

A primary accumulator 16 is depicted in direct fluid communication with the hydraulic cylinder 14.

An upper conductor guide 18 and a lower conductor guide 20 slidably engage the conductor 10.

The tension frame 30 transfers tension from the hydraulic cylinder 14 to the conductor 10, then to a riser 32 and a piece of well access equipment 13, as depicted.

Figure 3:
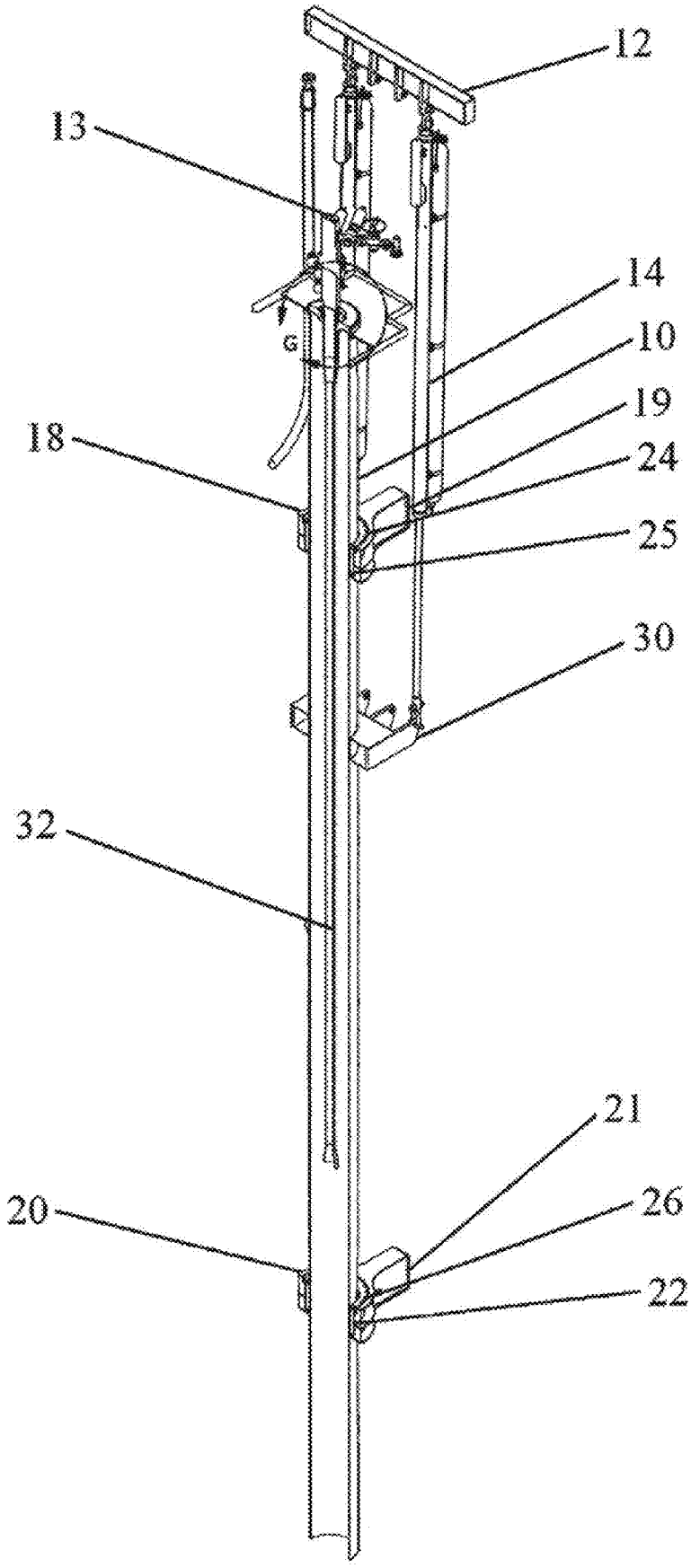
FIG. 3 is a cut view of the tensioner assembly.

FIG. 3 shows a cut view of the tensioner assembly 1. The well access equipment 13 is depicted secured to the conductor 10. The conductor 10 is secured to the well access equipment by a tension disc. The riser 32 extends through the center of the conductor 10. The hydraulic cylinder 14 is depicted secured to the tension frame 30 and the support frame 12.

The upper conductor guide retaining ring 24 is used to secure an upper conductor guide wear pad 25 to the upper conductor guide frame 19. The upper conductor guide ring 24, the upper conductor guide wear pad 25, and the upper conductor guide frame 19, form the upper conductor guide 18.

The lower conductor guide retaining ring 26 is used to secure a lower conductor guide wear pad 22 to the lower conductor guide frame 21. The lower conductor guide ring 26, the lower conductor guide wear pad 22, and the lower conductor guide frame 21, form the lower conductor guide 20.

Figure 4:
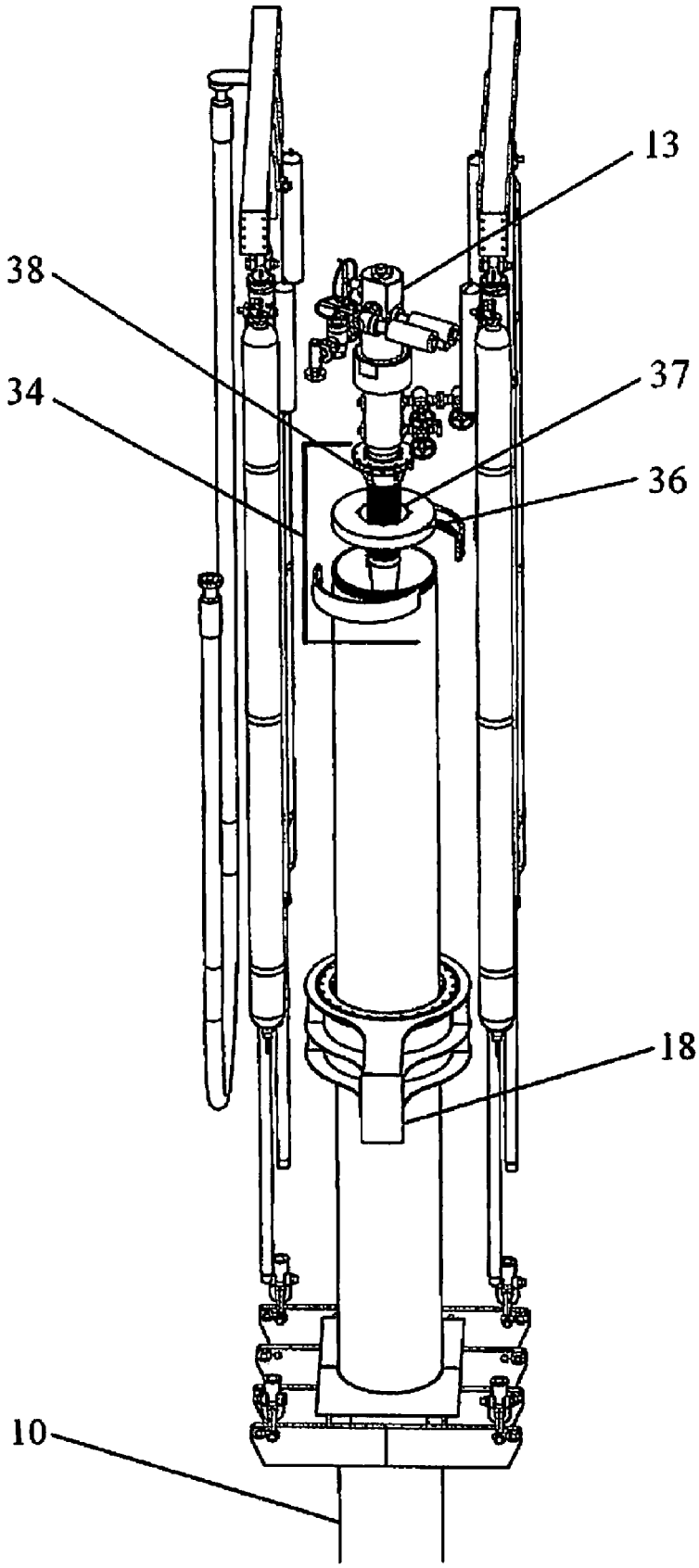
FIG. 4 is an exploded view of an embodiment of the tapered bowl tension ring assembly.
Figure 5:
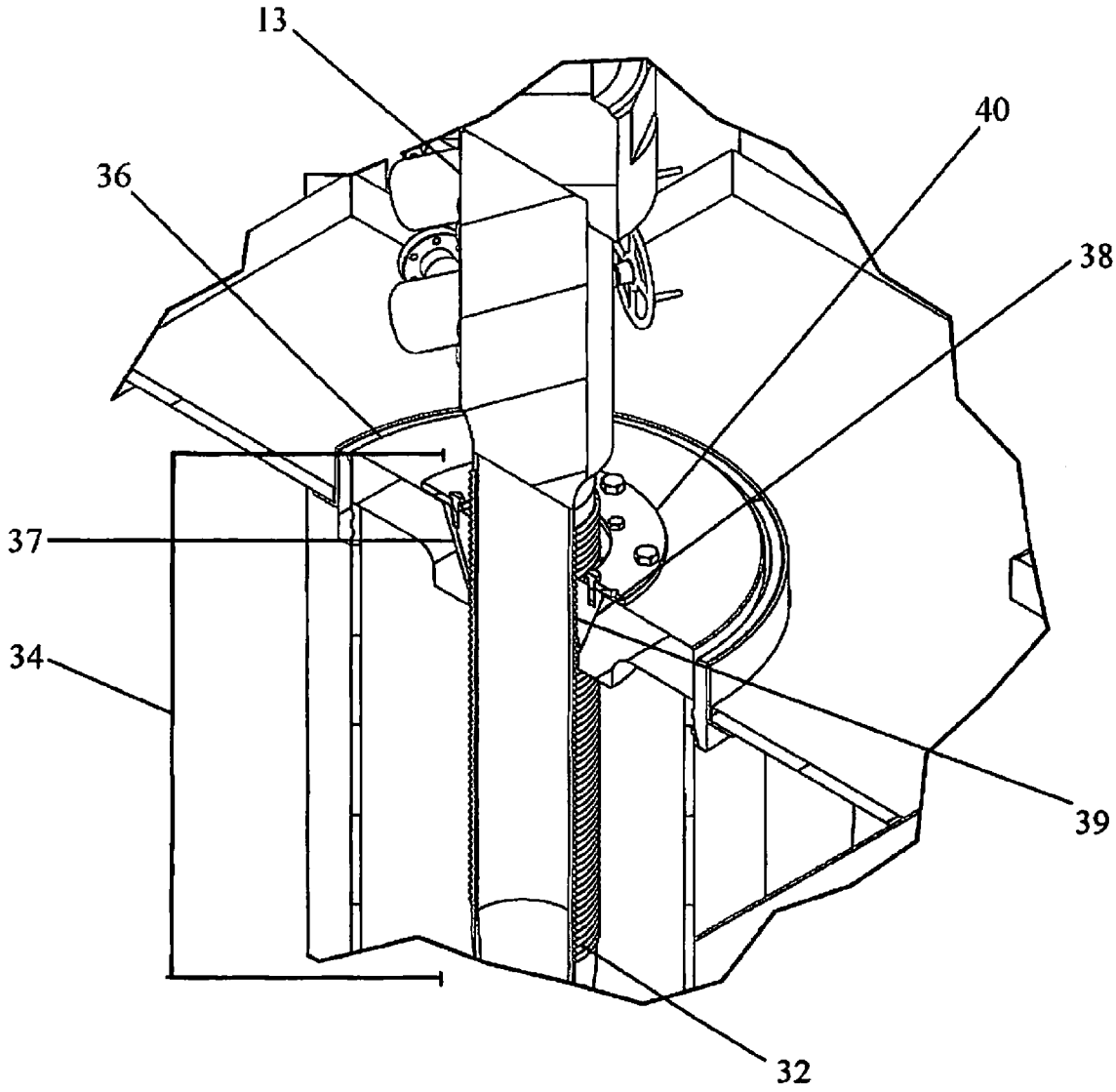
FIG. 5 is a cut view of an embodiment of the tapered bowl tension ring assembly.

Turning now to FIG. 4 and FIG. 5. A tapered bowl tension ring assembly 34 is depicted. The tapered bowl tension ring assembly 34 is disposed on the conductor 10 above the upper conductor guide 18.

The tapered bowl tension ring assembly 34 includes a tension disc 36. The tension disc 36 is depicted having a tapered center 37 for engaging the tapered collets 38. The tapered center 37 can be best seen in FIG. 5. The tapered center 37 can have a diameter for fitting commonly used riser diameters.

The tapered bowl assembly 34 has tapered collets 38 on threads 39. The threads 39 can be grooves. The threads 39 are for engaging the riser 32 in a secure connection. The tapered collets 38 engage the tension disc 36. A collet support ring 40 is disposed on the tapered collets 38 for supporting the tapered collets 38. The well access equipment 13 is depicted connected to the riser 32.

Figure 7:
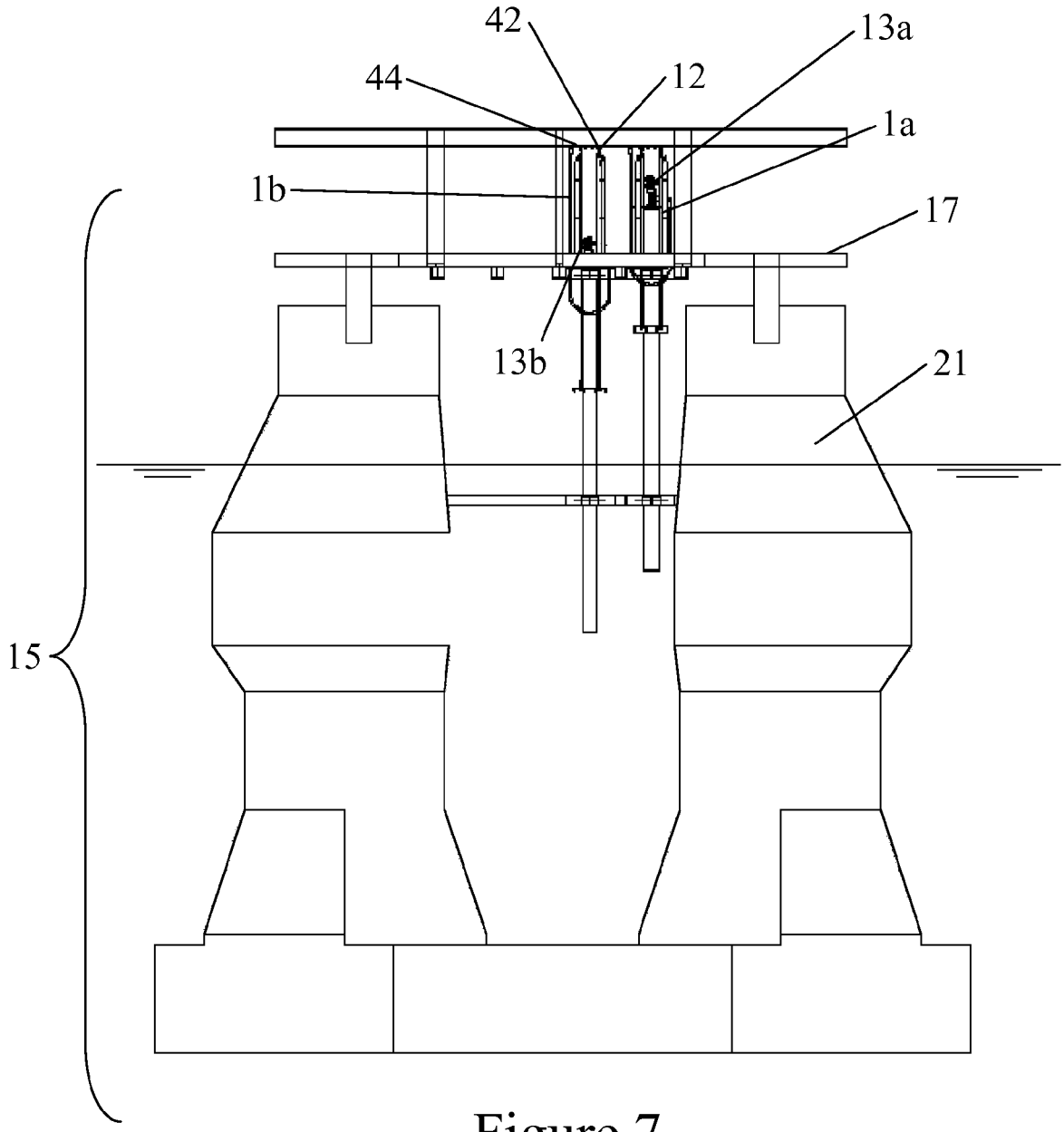
FIG. 7 depicts a side view of the floating vessel for supporting top tension drilling and production risers.

FIG. 7 depicts a side view of the floating vessel 15 for supporting top tension drilling and production risers. The floating vessel 15 supports a first tensioner assembly 1*a* and a second tensioner assembly 1*b*. The tensioner assemblies are described in detail below. The floating vessel is in communication with a wellhead.

The floating vessel has a hull 21 with an operations deck 17 disposed on top of the hull 21.

The second tensioner assembly 1*b* and the first tension assembly 1*a* have a support frame 12. The support frame 12 has a first beam 42 parallel to a second beam 44. The first beam 42 and the second beam 44 are secured to the floating vessel 15.

A first piece of well access equipment 13*a* is disposed in the floating vessel 15. A second piece of well access equipment 13*b* is secured to the floating vessel.

While these embodiments have been described with emphasis on the embodiments, it should be understood that within the scope of the appended claims, the embodiments might be practiced other than as specifically described herein.

What is claimed is:

1. A floating vessel for supporting top tension drilling and production risers comprising:

a. a hull and an operation deck disposed on top of the hull;

b. a tensioner assembly for moveably carrying a conductor that communicates from a wellhead to a piece of well access equipment connected to the floating vessel, wherein the tensioner assembly is supported by the floating vessel, and wherein the tensioner assembly comprises:

(i) at least one hydraulic cylinder secured to the floating vessel by a support frame, wherein the support frame comprises a first beam parallel to a second beam;

(ii) at least one primary accumulator in fluid communication with the at least one hydraulic cylinder, an upper conductor guide and a lower conductor guide slidably engaged with the conductor;

(iii) a tension frame secured to the conductor between the upper and the lower conductor guides for transferring tension from the at least one hydraulic cylinder to the conductor, and wherein the conductor transfers the tensions to the riser, and wherein the riser transfers the tensions to the piece of well access equipment; and (iv) a tension ring assembly disposed on the conductor above the upper conductor guide.

2. The floating vessel for supporting top tension drilling and production risers of claim 1, wherein the floating vessel for drilling operations comprises a semi-submersible floating vessel, a ship, a jack up floating vessel, a deep draft partially submersible and buoyant floating vessel, a tension leg platform, or a similar floating vessel.

3. The floating vessel for supporting top tension drilling and production risers of claim 1, wherein the first beam and the second beam are secured to the operation deck.

4. The floating vessel for supporting top tension drilling and production risers of claim 1, wherein the first beam and second beam each comprise a pad eye for supporting the at least one hydraulic cylinder.

5. The floating vessel for supporting top tension drilling and production risers of claim 1, wherein the support frame is a self supporting frame disposed on the floating vessel.

6. The floating vessel for supporting top tension drilling and production risers of claim 1, wherein the support frame is a cassette frame.

7. The floating vessel for supporting top tension drilling and production risers of claim 1, wherein the upper and lower conductor guides each comprise a guide frame for supporting a conductor guide wear pad.

8. The floating vessel for supporting top tension drilling and production risers of claim 1, wherein the floating vessel for supporting top tension drilling and production risers comprises a plurality of tensioner assemblies supported by the floating vessel for supporting top tension drilling and production risers.

* * * * *